US008188888B2

(12) United States Patent
Hagl et al.

(10) Patent No.: US 8,188,888 B2
(45) Date of Patent: May 29, 2012

(54) METHOD AND TRAFFIC CONTROL SYSTEM FOR CONTROLLING TRAFFIC FLOWS INCLUDING HAZARDOUS MATERIAL OR ABNORMAL LOAD TRANSPORTATION UNITS

(75) Inventors: Peter Hagl, Vienna (AT); Markus Moser, Graz (AT); Martin Pelzmann, Graz (AT); Alfred Pohl, Mistelbach (AT); Matthias Zimmermann, Vienna (AT)

(73) Assignee: Siemens Aktiengesellschaft, München (DE)

( * ) Notice: Subject to any disclaimer, the term of this patent is extended or adjusted under 35 U.S.C. 154(b) by 497 days.

(21) Appl. No.: 12/311,712

(22) PCT Filed: Sep. 6, 2007

(86) PCT No.: PCT/EP2007/059317

§ 371 (c)(1),
(2), (4) Date: Apr. 9, 2009

(87) PCT Pub. No.: WO2008/043613

PCT Pub. Date: Apr. 17, 2008

(65) Prior Publication Data

US 2009/0322564 A1 Dec. 31, 2009

(30) Foreign Application Priority Data

Oct. 13, 2006 (DE) ..... 10 2006 048 627

(51) Int. Cl.
*G08G 1/095* (2006.01)

(52) U.S. Cl. ..... 340/907; 340/931; 340/572.1; 340/572.4

(58) Field of Classification Search ..... 340/928, 340/907, 539.13, 539.22, 572.1, 572.4, 931, 340/573.3

See application file for complete search history.

(56) References Cited

U.S. PATENT DOCUMENTS

| | | | | |
|---|---|---|---|---|
| 5,008,661 | A * | 4/1991 | Raj | 340/10.51 |
| 5,347,274 | A | 9/1994 | Hassett | |
| 6,729,540 | B2 | 5/2004 | Ogawa | |
| 6,754,580 | B1 | 6/2004 | Ask et al. | |
| 6,995,673 | B1 * | 2/2006 | Osredkar et al. | 340/572.1 |
| 7,336,178 | B2 * | 2/2008 | Le | 340/572.1 |
| 2005/0156734 | A1 * | 7/2005 | Zerwekh et al. | 340/539.1 |

FOREIGN PATENT DOCUMENTS

| | | | |
|---|---|---|---|
| DE | 19900721 | A1 | 7/2000 |
| EP | 1376510 | A | 1/2004 |
| WO | WO 0122035 | A | 3/2001 |
| WO | WO 2006088916 | A | 8/2006 |

* cited by examiner

*Primary Examiner* — Hung T. Nguyen

(57) ABSTRACT

Disclosed are a method and a traffic routing system for controlling traffic flows in which hazardous or special material is transported through safety-critical traffic zones such as tunnels, bridges or locks. In the method and traffic routing system, safety-relevant data is read with the help of a signal transmitter disposed on the transported hazardous or special material and is transmitted to a central computer unit when said vehicle passes reading devices located in the safety-critical traffic zone. The central computer unit determines a safety risk in the safety-critical traffic zone on the basis of the safety-relevant data of all transported hazardous or special material located in the safety-critical traffic zone and sets traffic routing signals.

12 Claims, 2 Drawing Sheets

METHOD AND TRAFFIC CONTROL SYSTEM FOR CONTROLLING TRAFFIC FLOWS INCLUDING HAZARDOUS MATERIAL OR ABNORMAL LOAD TRANSPORTATION UNITS

CROSS REFERENCE TO RELATED APPLICATIONS

This application is the US National Stage of International Application No. PCT/EP200/059317 filed Sep. 6, 2007 and claims the benefit thereof. The International Application claims the benefits of German Patent Application No. 10 2006 048 627.7 DE filed Oct. 13, 2006, both of the applications are incorporated by reference herein in their entirety.

FIELD OF INVENTION

The invention relates to a method for controlling traffic flows including hazardous material or abnormal load transportation units through safety-critical traffic zones, such as tunnels, bridges or locks for example.

The invention also relates to a traffic control system for controlling traffic flows including hazardous material or abnormal load transportation units through safety-critical traffic zones, such as tunnels, bridges or locks for example.

BACKGROUND OF INVENTION

Methods and traffic control systems for controlling traffic flows are known from the prior art, which measure lane conditions or traffic density for example and set traffic control signals, such as speed restrictions or general vehicle bans for example. Traffic control systems, which also take into account traffic density, are based here on contactless detection devices for vehicles, for example optical cameras.

SUMMARY OF INVENTION

Such systems are however not suitable for controlling traffic flows including hazardous material or abnormal load transportation units through safety-critical traffic zones such as tunnels, bridges or locks, as these require information about the presence and nature of hazardous materials for example. Automated requests for such information cannot be implemented using optical cameras alone. There is also the general problem of how to proceed when controlling traffic flows including hazardous material or abnormal load transportation units through safety-critical traffic zones. It is known that general speed restrictions can be provide in the region of tunnels, to reduce the general accident risk but such a measure sometimes also reduces the traffic flow.

An object of the invention is to use a method or traffic control system for controlling traffic flows including hazardous material or abnormal load transportation units through safety-critical traffic zones to minimize the safety risk associated with hazardous material or abnormal load transportation units selectively, without impeding the general traffic flow for all other vehicles unnecessarily in the process.

The object is achieved by a method and a system as claimed in the claims. Disclosed is a method for controlling traffic flows including hazardous material or abnormal load transportation units through safety-critical traffic zones, such as tunnels, bridges or locks for example. Provision is made for safety-relevant data to be read out with the aid of a signal transmitter disposed on the hazardous material or abnormal load transportation units as they pass read devices disposed in the safety-critical traffic zone and to be transmitted to a central computation unit, the central computation unit using the safety-relevant data of all the hazardous material or abnormal load transportation units present in the safety-critical traffic zone to determine a safety risk in the safety-critical traffic zone and to set traffic control signals, which reduce the accident risk for a hazardous material or abnormal load transportation unit in the safety-critical traffic zone to avoid an impermissible safety risk. The abnormal loads can also be buses or heavy vehicles of all types.

Intervention then only takes place in the traffic flow if hazardous material or abnormal load transportation units are actually present in the safety-critical traffic zone. To this end provision is made for specific signal transmitters, which are provided on the hazardous material or abnormal load transportation units, for example RFID transponders. But even when a hazardous material or abnormal load transportation unit is present in the safety-critical traffic zone, it is possible first to use the existing safety-relevant data for the relevant transportation unit to evaluate the safety risk that results in combination with another hazardous material or abnormal load transportation unit. If an impermissible safety risk is anticipated, traffic control signals are set, which reduce the accident risk for a hazardous material or abnormal load transportation unit in the safety-critical traffic zone.

In order not to impede the general traffic flow unnecessarily in this process, it is provided for the central computation unit to set traffic control signals which prevent an additional hazardous material or abnormal load transportation unit entering the safety-critical traffic zone, if there is already a hazardous material or abnormal load transportation unit present in the safety-critical traffic zone. No general speed limits or similar measures, which influence the general traffic flow, are therefore instituted; the additional hazardous material or abnormal load transportation units are simply prevented from entering the safety-critical traffic zone. To this end the traffic control signal can consist of a stop signal for a hazardous material or abnormal load transportation unit in the entry zone of a safety-critical traffic zone.

The claimed system a traffic control system for controlling traffic flows including hazardous material or abnormal load transportation units through safety-critical traffic zones, such as tunnels, bridges or locks for example. Provision is made here for the hazardous material or abnormal load transportation units to be equipped with a signal transmitter for safety-relevant data and for read devices for the signal transmitters to be disposed in the safety-critical traffic zone and for a central computation unit to be provided, which is connected on the one hand to the read devices for transmitting the safety-relevant data read out as a signal transmitter passes and on the other hand to a traffic control facility, which sets traffic control signals for a safety risk determined using the safety-relevant data of all the hazardous material or abnormal load transportation units present in the safety-critical traffic zone, to avoid an impermissible safety risk, said traffic control signals reducing the accident risk for a hazardous material or abnormal load transportation unit in the safety critical traffic zone.

The read devices are disposed in the entry and exit zones of the safety-critical traffic zone and the traffic control facility comprises a controllable stop signal in the entry and exit zones of the safety-critical traffic zone. This allows an additional hazardous material or abnormal load transportation unit to be prevented from entering the safety-critical traffic zone, if a hazardous material or abnormal load transportation unit is already present in the safety-critical traffic zone.

The signal transmitter is an RFID transponder.

BRIEF DESCRIPTION OF THE DRAWINGS

The invention is described in more detail below with reference to an exemplary embodiment and with the aid of the accompanying drawings, in which.

DETAILED DESCRIPTION OF INVENTION

FIGS. 1 to 4 show a possible embodiment of the method or traffic control system, in which a safety-critical traffic zone 1, perhaps a tunnel, is to be accessible for just one hazardous material or abnormal load transportation unit 7. FIGS. 1 to 4 here only show the hazardous material or abnormal load transportation unit 7 but the traffic flow consists of a plurality of other vehicles in addition to the hazardous material or abnormal load transportation unit 7; said other vehicles however do not represent an increased potential danger in the safety-critical traffic zone 1 and are not shown in FIGS. 1 to 4. The safety-critical zone 1 can be an exposed section of road, a road tunnel, a rail tunnel, a maritime lock, a bridge, etc.

The hazardous material or abnormal load transportation unit 7.1 moves toward the safety-critical zone 1 in the marked arrow direction and is equipped with a signal transmitter 4, perhaps an RFID (Radio Frequency Identification) transponder. The signal transmitter 4 contains safety-relevant data relating to the vehicle in question, such as nature of load, total volume of load, dimensions of vehicle or vehicle weight. The hazardous material or abnormal load transportation unit 7.1 can be any type of heavy vehicle or other vehicles with a greater need for protection, such as buses.

Figure 1:
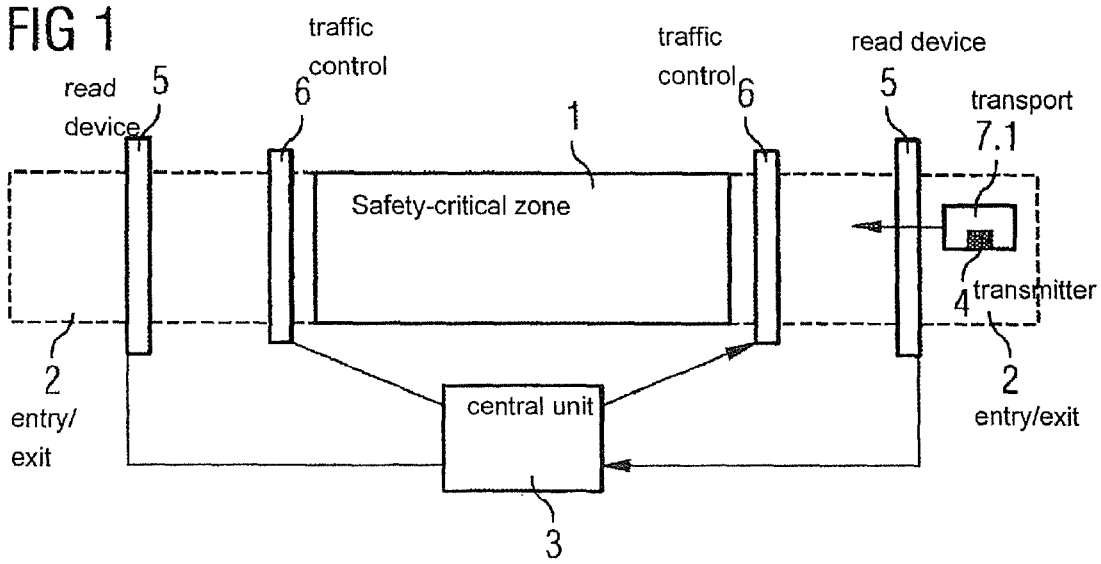
FIG. 1 shows a schematic diagram of a safety-critical zone and the entry of a first hazardous material or abnormal load transportation unit into this zone.

The safety-relevant data on the signal transmitter 4 is read out by read devices 5, which are disposed in the entry and exit zones 2 of the safety critical zone 1 in the exemplary embodiment shown in FIG. 1. Different embodiments of RFID transponders are known, which can be used in principle for the method or the traffic control system. What are known as "passive" RFID transponders are particularly advantageous as these do not require their own energy supply and can therefore be assembled easily and economically and also have a long service life. The read devices 5 then scan the data contained on the RFID transponders in the conventional manner. It is however also possible to use RFID transponders, which have their own energy supply, perhaps to extend the data exchange range. RFID transponders of this type are also known as "semi-active" or "active" transponders. The read devices 5 can then also be embodied as receive facilities for the data transmitted from the RFID transponder.

The read device 5 transmits the data with the aid of a cable connection or a radio connection based on UMTS or GPRS to the central computation unit 3. The central computation unit 3 can be located in spatial proximity to the safety-critical traffic zone 1, perhaps in the control center of a tunnel, or it can be spatially remote, perhaps in a central traffic control center monitoring a number of sections of road. The central computation unit 3 uses the safety-relevant data of all the hazardous material or abnormal load transportation units **7.*n* present in the safety-critical traffic zone to determine a safety risk in the safety-critical zone 1 and sets traffic control signals, which reduce the accident risk for a hazardous material or abnormal load transportation unit 7.*n* in the safety-critical traffic zone 1**, to avoid an impermissible safety risk.

In the exemplary embodiment shown according to FIG. 1 there is no further hazardous material or abnormal load transportation unit **7.*n* in the safety critical traffic zone 1, so there is no concern about the entry of the hazardous material or abnormal load transportation unit 7.1. The traffic control facility 6, perhaps a controllable stop signal, is therefore activated by the central computation unit 3 so that it permits the entry of the hazardous material or abnormal load transportation unit 7.1**.

Figure 2:
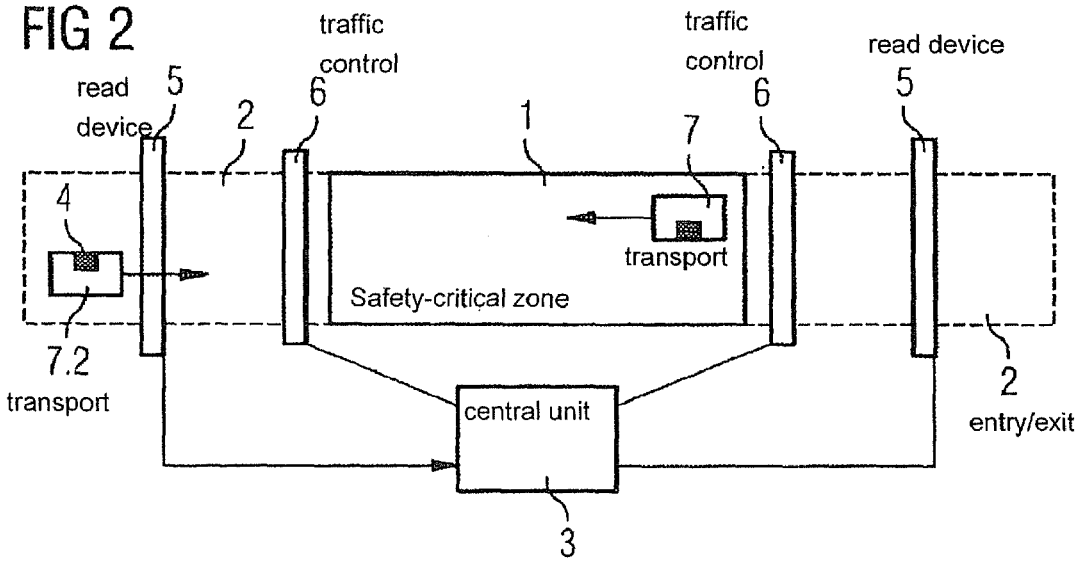
FIG. 2 shows a schematic diagram according to FIG. 1, in which an additional, second hazardous material or abnormal load transportation unit approaches the safety-critical zone.

As shown in FIG. 2, as a further hazardous material or abnormal load transportation unit 7.2 approaches in the entry zone 2 of the safety-critical traffic zone 1, the safety-relevant data relating to the hazardous material or abnormal load transportation unit 7.2 is again read by the corresponding read device 5 and sent to the central computation unit 3. However the central computation unit 3 has been informed of the presence of the first hazardous material or abnormal load transportation unit 7.1 within the safety-critical traffic zone 1 and now takes a decision whether both hazardous material or abnormal load transportation units 7.1 and 7.2 can be allowed to be present in the safety-critical zone 1 at the same time. For example the sum of the loaded, combustible substances on two hazardous material transportation units 7.1 and 7.2 could overload the safety systems of a tunnel or buses might not be permitted to enter the tunnel for safety reasons when a hazardous material transportation unit 7.1 is passing through, etc. It is also possible for the permitted load for a bridge to be exceeded, if additional hazardous material or abnormal load transportation units **7.*n* are allowed into the safety-critical zone 1, in this instance a bridge. It is also possible for the decision concerning whether a hazardous material or abnormal load transportation unit 7.*n* should be allowed into a safety-critical region 1 also to be made taking into account external parameters, such as wind speed in a particularly exposed valley crossing. In this instance it would be possible for a hazardous material or abnormal load transportation unit 7.*n*** to be refused permission to cross if its cross-sectional surface subject to wind loading were too large, with the corresponding dimensions likewise being among the transmitted safety-relevant data.

Figure 3:
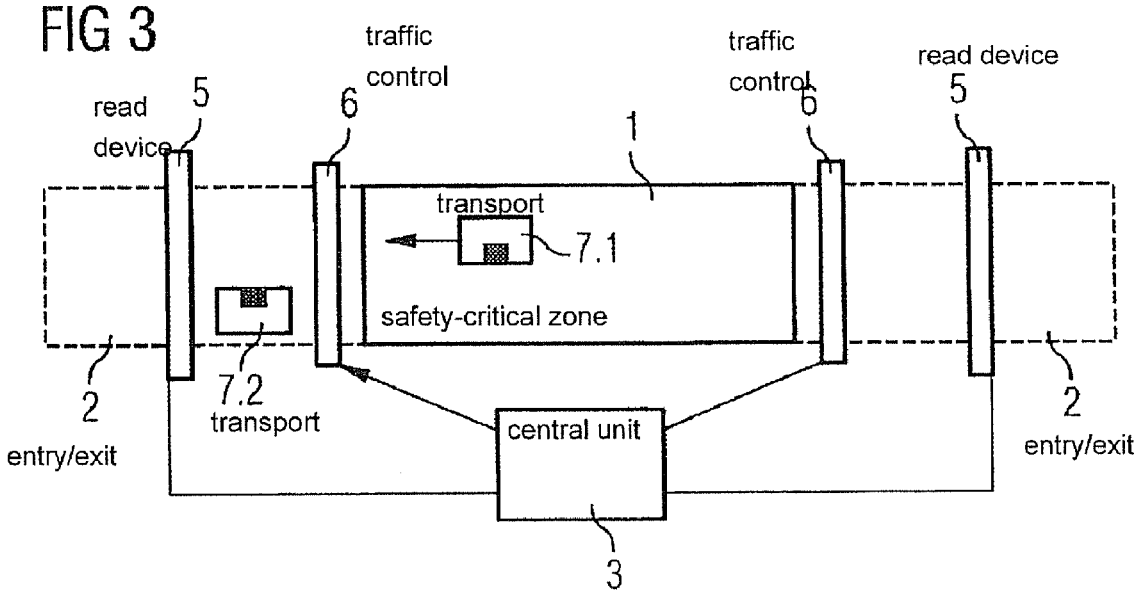
FIG. 3 shows a schematic diagram according to FIG. 2, in which the additional, second hazardous material or abnormal load transportation unit is stopped before the safety-critical zone

In the exemplary embodiment shown the passage of the hazardous material or abnormal load transportation unit 7.2 is to be temporarily prohibited, so the central computation unit 3 sends a stop signal for example to the corresponding traffic control facility 6 (FIG. 3). It would however also be possible for a general speed restriction to be instituted temporarily as a traffic control signal, or another measure known to the person skilled in the art of traffic telematics to reduce the accident risk for a hazardous material or abnormal load transportation unit **7.*n* in the safety-critical traffic zone 1**.

Figure 4:
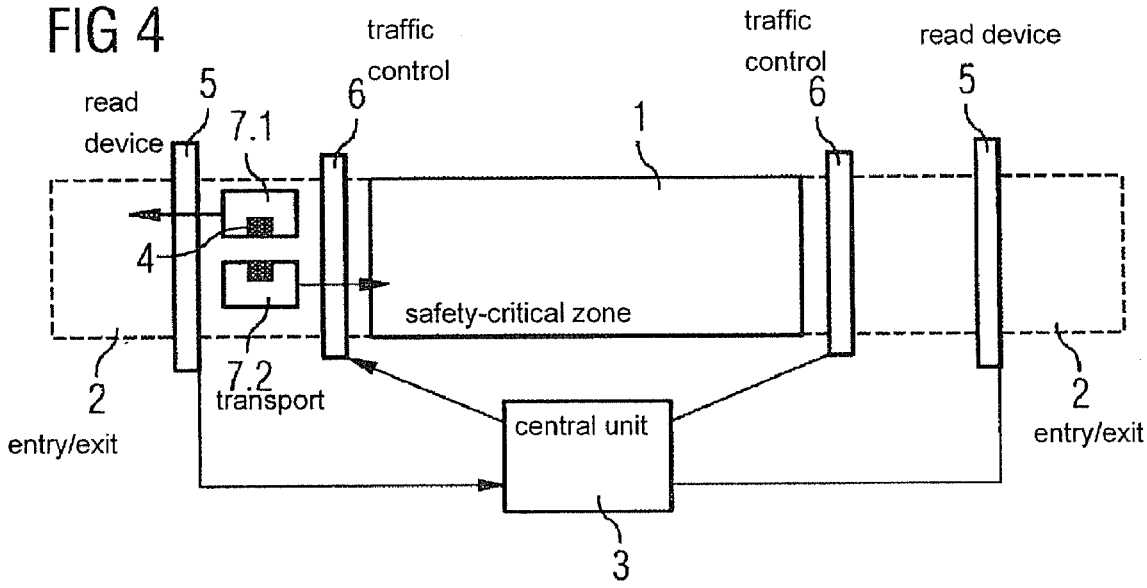
FIG. 4 shows a schematic diagram according to FIG. 3, in which the first hazardous material or abnormal load transportation unit has left the safety-critical zone and the additional, second hazardous material or abnormal load transportation unit is given permission to enter the safety-critical zone.

As it leaves the safety-critical traffic zone 1 the first hazardous material or abnormal load transportation unit 7.1 passes a read device 5, which reads out the safety-relevant data of the hazardous material or abnormal load transportation unit 7.1 in question and transmits it to the central computation unit 3. The central computation unit 3 is thus informed that the hazardous material or abnormal load transportation unit 7.1 has left the safety-critical traffic zone 1. As there are no further hazardous material or abnormal load transportation units 7.*n* in the safety-critical traffic zone 1, the waiting hazardous material or abnormal load transportation unit 7.2 is allowed to pass (FIG. 4).

The use of signal transmitters 4, such as RFID transponders also has the advantage that the loading of hazardous material or abnormal load transportation units 7.*n* is known at all times. It is thus possible to optimize rescue measures for example in the event of an accident. Also data relating to the dimensions of the relevant hazardous material or abnormal load transportation unit 7.*n* can be compared with local conditions in the safety-critical region 1, perhaps a subway, to be able to identify potential dangers in this manner.

The invention thus allows a method or traffic control system for controlling traffic flows including hazardous material or abnormal load transportation units 7.*n* through safety-critical traffic regions 1 to be realized, which minimizes the safety risk associated with hazardous material or abnormal load transportation units 7.*n* selectively, without impeding the general traffic flow for all other vehicles unnecessarily in the process.

The invention claimed is:

1. A method for controlling traffic flows having hazardous material or abnormal load transportation units through safety-critical traffic zones, comprising:

reading out safety-relevant data from a signal transmitter disposed on a hazardous material or abnormal load transportation units when it passes by a read devices disposed at an entry zone of the safety-critical traffic zone;

transmitting the safety-relevant data from the transportation unit at the entry zone to a central computation unit;

determining a safety risk in the safety-critical traffic zone by the central computation unit, the central computation unit comparing the safety-relevant data from the transportation unit at the entry zone with the safety-relevant data of all the hazardous material or abnormal load transportation units currently present in the safety-critical traffic zone; and regulating the flow of traffic by setting traffic control signals by the central computation unit to avoid an impermissible safety risk, the traffic control signals reducing the accident risk for a hazardous material or abnormal load transportation unit in the safety-critical traffic zone.

2. The method as claimed in claim 1, wherein the central computation unit sets traffic control signals which prevent an additional hazardous material or abnormal load transportation unit entering the safety-critical traffic zone when there is already a hazardous material or abnormal load transportation unit present in the safety-critical traffic zone.

3. The method as claimed in claim 2, wherein the traffic control signal is a stop signal for a hazardous material or abnormal load transportation unit in the entry zone of the safety-critical traffic zone to prevent more than one hazardous material or abnormal load transportation unit present in the safety-critical traffic zone at the same time when determined to be a safety risk.

4. The method as claimed in claim 1, wherein the traffic control signal is a stop signal for a hazardous material or abnormal load transportation unit in the entry zone of the safety-critical traffic zone.

5. A traffic control system for controlling traffic flows having hazardous material or abnormal load transportation units through safety-critical traffic zones, comprising:

a signal transmitter for safety-relevant data, the hazardous material or abnormal load transportation units being equipped with the signal transmitter;

read devices for reading the signal transmitters, the read devices being disposed at an entry zone of the safety-critical traffic zone;

a traffic control facility; and a central computation unit connected to the read devices for transmitting the safety-relevant data read out as a signal transmitter passes and connected to the traffic control facility, the traffic control facility regulating the flow of traffic by setting traffic control signals when a safety risk is determined by the central computation unit comparing the safety-relevant data from the transportation unit at the entry zone with the safety-relevant data of all the hazardous material or abnormal load transportation units present in the safety-critical traffic zone to avoid an impermissible safety risk, the traffic control signals reducing the accident risk for a hazardous material or abnormal load transportation unit in the safety critical traffic zone.

6. The traffic control system as claimed in claim 5, wherein the read devices are disposed in the entry and exit zones at each end of the safety-critical traffic zone.

7. The traffic control system as claimed in claim 6, wherein the traffic control facility comprises a controllable stop signal in the entry and exit zones of the safety-critical traffic zone.

8. The traffic control system as claimed in claim 6, wherein the signal transmitter is an RFID transponder.

9. The traffic control system as claimed in claim 7, wherein the signal transmitter is an RFID transponder.

10. The traffic control system as claimed in claim 5, wherein the traffic control facility comprises a controllable stop signal in the entry and exit zones at each end of the safety-critical traffic zone to prevent more than one hazardous material or abnormal load transportation unit present in the safety-critical traffic zone at the same time when determined to be a safety risk.

11. The traffic control system as claimed in claim 10, wherein the signal transmitter is an RFID transponder.

12. The traffic control system as claimed in claim 5, wherein the signal transmitter is an RFID transponder.

* * * * *